United States Patent [19]

Cheney

[11] Patent Number: 4,502,885

[45] Date of Patent: Mar. 5, 1985

[54] METHOD FOR MAKING METAL POWDER

[75] Inventor: Richard F. Cheney, Athens, Pa.

[73] Assignee: GTE Products Corporation, Stamford, Conn.

[21] Appl. No.: 598,134

[22] Filed: Apr. 9, 1984

[51] Int. Cl.[3] ..... B22F 9/00

[52] U.S. Cl. ..... 75/0.5 B; 75/0.5 C

[58] Field of Search ..... 75/0.5 C, 0.5 B, 0.5 BA, 75/0.5 BB, 0.5 R, 251

[56] References Cited

U.S. PATENT DOCUMENTS 4,221,587 9/1980 Ray ..... 75/0.5 C
4,240,824 12/1980 Moskowitz et al. ..... 75/0.5 C
4,264,354 4/1981 Cheetham ..... 75/251
4,390,368 6/1983 Houck ..... 75/251

*Primary Examiner*—W. Stallard
*Attorney, Agent, or Firm*—Robert E. Walter

[57] ABSTRACT

A fine powder is prepared by directing a high velocity stream of molten droplets into a cooling fluid to form rapidly solidified powder. The powder is subjected to comminution at an energy sufficient to fragment at least a portion of the particles which are not completely rapidly solidified. The fragmented particles are removed to give a powder containing a greater proportion of rapidly solidified particles than the original mixture.

1 Claim, No Drawings

METHOD FOR MAKING METAL POWDER

FIELD OF INVENTION

The present invention relates to a process for making rapidly cooled fine metal powders.

BACKGROUND OF THE INVENTION

U.S. Pat. No. 3,646,177 to Thompson discloses a method for producing powdered metals and alloys that are free from oxidation by a process which involves atomizing molten metal with a fluid jet to form discrete particles of the molten metal. The jet is directed into a reservoir of an inert cryogenic liquid to solidify the particles and prevent oxidation during cooling.

U.S. Pat. No. 4,069,045 to Lundgren describes a process wherein a jet of molten metal is impinged against a rotating flat disc. Relatively thin, brittle, easily shattered, and essentially dentrite free metal flakes are obtained. These flakes are also described in U.S. Pat. No. 4,063,942 to Lundgren.

U.S. Pat. No. 4,221,587 to Ray relates to a method of making powder by impinging a jet of molten alloy at an acute angle against the inner surface of a rotating cylindrical chill body. As set forth in column 5, the impinging molten metal breaks into a stream of discrete droplets which bounce off the surface and move in the direction of the chill surface. Upon impact with the chill surface, the droplets are solidified at a rapid rate. As set forth in column 6, "the glassy metal powder particles ... have relatively sharp notched edges which enable the particles to interlock during compaction." As set forth in the first example, the particle size of the powder is such that 90% of the particles have a particle size range between about 25 and 300 microns.

U.S. Pat. No. 3,909,241 to Cheney et al relates to free flowing powders which are produced by feeding agglomerates through a high temperature plasma reactor to cause at least partial melting of the particles and collecting the particles in a cooling chamber containing a protective gaseous atmosphere where the particles are solidified.

SUMMARY OF INVENTION

Rapidly cooled metal or metal alloy powders are desirable for many applications. However, particles of this nature are very difficult to obtain. Prior art techniques, where a liquid impinges a cold surface require subsequent comminution of the material formed. In general, the powders are often high in atmosphere impurities such as oxygen, nitrogen or impurities from the grinding medium used to obtain the small size.

In accordance with the present invention, there is provided a powder consisting essentially of single phase rapidly solidified particles have smooth surfaces.

Also, in accordance with the present invention, there is provided a process for preparing a rapidly solidified powder comprising containing an agglomerated metal powder in a carrier gas, feeding the entrained agglomerated powder through a high temperature reactor to form a stream of dispersed particles, one portion of said dispersed particles being substantially completely melted and another portion being partially melted, directing said stream of dispersed particles into a cooling fluid at a temperature sufficient to subject said particles to conditions of rapid solidification and form an initial mixture of particles comprising substantially completely solidified particles from said one portion and partially solidified particles from said other portion, said substantially completely solidified spherically shaped particles requiring a first amount of energy for comminution and said partially solidified particles requiring a second amount of energy for communinution, said secod amount of energy being less than said first amount of energy, subjecting said mixture to an energy for comminution intermediate said first and second energy for preferentially comminuting said other portion as compared with said one portion to give a resulting mixture containing comminuted particles, and separating a portion of said comminuted particles to give a final mixture including a greater proportion of said one portion rapidly solidified particles than comprising initial mixture.

DETAILED DESCRIPTION

High velocity streams of molten metal droplets may be formed by thermal spraying.

The preferred powders are metals and metal alloys. Low melting metals or alloys may include zinc, lead, silver or gold. Higher melting point metals and alloys typically contain copper, cobalt, iron and nickel may be used. The refractory metals and alloys which typically have melting points in excess of 1800 degrees centirade are of particular interest. The refractory type metals include molybdenum, niobium, tungsten, tantalum, chromium alloys and mixtures thereof. The term metals include elemental metals, alloys, pure or mixed oxides, borides, carbides and nitrides of metal with or without additives.

Since the powders of the present invention are produced by rapid cooling, at least some of the powders contain particles having amorphous phases or metastable crystal structures. Metal alloys which are most easily obtained in the amorphous state by rapid quenching or by deposition techniques are mixtures of transition metals. The cooling rate necessary to achieve the amorphous state depends on the composition of the alloys.

Generally, there is a small range of compositions surrounding each of the known compositions where the amorphous state can be obtained. However, apart from quenching the alloys, no practical guideline is known for predicting with certainty which of the multitude of different alloys will yield an amorphous metal with given processing conditions. Examples of amorphous alloys formed by rapid quenching are described in U.S. Pat. No. 3,856,513 to Ohen et al, U.S. Pat. Nos. 3,427,154 and 3,981,722, as well as others.

The amorphous and crystalline state are distinguished most readily by differences in X-ray diffraction measurement. Diffraction patterns of an amorphous substance reveal a broad halo similar to a liquid. Crystalline materials produce a line or broadened line diffraction pattern. The amorphous alloys provided by the present invention appear to be liquid when studied from X-ray diffraction patterns, but the alloy is solid when studied in terms of hardness and viscosity. An amorphous alloy structure is inherently metastable, i.e., the state is non-equilibrium. Since the atoms of the amorphous structure are not arranged in a periodic array, there is at any temperature a tendency of the amorphous structure to transform toward the crystalline structure of the equilibrium state through diffusion or segregation of components of the alloy.

The rapidly cooled powder particles of the present invention preferably have a particle size distribution wherein at least about 80 percent of the particles have a particle size within a 50 micrometers of the average particle size. Depending on the composition and exact conditions of powder formation, even smaller particle size distributions wherein at least 90 percent of the particles have a particle size within 50 micrometers of the average particle size.

The particles of the present invention are preferably cooled from molten materials to give a characteristic curvilinear surface to the particles. Due to surface tension, airborn molten material tends to contract until the smallest surface area consistent with its volume is occupied. The tendency of the molten material is to form spheres. If the rapidly cooled particles solidify prior to assuming the shape of a sphere or molten particles collide during cooling, the molten droplets may form elliptically shaped or elongated particles with rounded ends.

The powders of the present invention differ from milled or fractured powders which are characterized by an irregularly shaped outline which may have sharp or rough edges.

In preparing the powders of the present invention, a high velocity stream of molten metal droplets is formed. Such a stream may be formed by any thermal spraying technique such as electric-arc spraying, combustion spraying and plasma spraying. Typically, the velocity of the molten droplets is greater than about 100 meters per second, preferably greater than about 200 meters per second, and more preferably greater than 250 meters per second. Velocities on the order of 900 meters per second or greater may be achieved under certain conditions which favor these speeds which may include spraying in a vacuum.

In the preferred process of the present invention, a powder is fed through a thermal spray apparatus. Feed powder is entrained in a carrier gas and then fed through a high temperature reactor. The temperature in the reactor is preferably above the melting point of the highest melting component of the metal powder and even more preferably above the vaporization point of the lowest vaporizing component of the material to enable a relatively short residence time in the reaction zone.

The stream of dispersed entrained molten metal droplets may be produced by plasma-jet torch or gun apparatus of conventional nature. Typical plasma jet apparatus is of the resistance arc or induction type. In general, a source of metal powder is connected to a source of propellant gas. A means is provided to mix the gas with the powder and propel the gas with entrained powder through a conduit communicating with a nozzle passage of the plasma spray apparatus. In the arc type apparatus, the entrained powder may be fed into a vortex chamber which communicates with and is coaxial with the nozzle passage which is bored centrally through the nozzle. In an arc type plasma apparatus, an electric arc is maintained between an interior wall of the nozzle passage and an electrode present in the passage. The electrode has a diameter smaller than the nozzle passage with which it is coaxial to so that the gas is discharged from the nozzle in the form of a plasma jet. The current source is normally a DC source adapted to deliver very large currents at relatively low voltages. By adjusting the magnitude of the arc power and the rate of gas flow, torch temperatures can range from 150 degrees centigrade up to about 15,000 degrees centigrade. The apparatus generally must be adjusted in accordance with the melting point of the powders being sprayed and the gas employed. In general, the electrode may be retracted within the nozzle when lower melting powders are utilized with an inert gas such as nitrogen while the electrode may be more fully extended within the nozzle when higher melting powders are utilized with an inert gas such as argon.

In the induction type plasma spray apparatus, metal powder entrained in an inert gas is passed at a high velocity through a strong magnetic field so as to cause a voltage to be generated in the gas. The current source is adapted to deliver very high currents, on the order of 10,000 amperes, although the voltage may be relatively low such as 10 volts. Such currents are required to generate a very strong direct magnetic field and create a plasma. Such plasma devices may include additional means for aiding in the initiation of a plasma generation, a cooling means for the torch in the form of annular chamber around the nozzle.

In the plasma process, a gas which is ionized in the torch regains its heat of ionization on exiting the nozzle to create a highly intense flame. In general, the flow of gas through the plasma spray apparatus is effected at speeds at least approaching the speed of sound. The typical torch comprises a conduit means having a convergent portion which converges in a downstream direction to a throat. The convergent portion communicates with an adjacent outlet opening so that the discharge of plasma is effected out the outlet opening.

Other types of torches may be used such as an oxy-acetylene type having high pressure fuel gas flowing through the nozzle. The powder may be introduced into the gas by an aspirating effect. The fuel is ignited at the nozzle outlet to provide a high temperature flame.

Preferably the powders utilized for the torch should be uniform in size, and composition and relatively free flowing. Flowability is desirable to aid in the transportation and injection of the powder into the plasma flame. In general, fine powders (less than 40-micrometers average diameter) do not exhibit good flow characteristics. A narrow size distribution is disirable because, under set flame conditions, the largest particles may not melt completely, and the smallest particles may be heated to the vaporization point. Incomplete melting is a detriment to the product uniformity, whereas vaporization and decomposition decreases process efficiency. Typically, the size ranges for plasma feed powders are such that 80 percent of the particles fall within a 30 micrometer diameter range with the range of substantially all the particles within a 60 micrometer range.

U.S. Pat. No. 3,909,241 to Cheney et al describes a process for preparing smooth, substantially spherical particles having an apparent density of at least 40 percent of the theoretical density of the material. By plasma densifying an agglomerate obtained by spray drying, metals which typically will not alloy in a melt may be intimately mixed in non-equilibrium phases to form a uniform powder composition.

The stream of entrained molten metal droplets which issues from the nozzle tends to expand outwardly so that the density of the droplets in the stream decreases as the distance from the nozzle increases. Prior to impacting a surface, the stream typically passes through a gaseous atmosphere which solidifies and decrease the velocity of the droplets. As the atmosphere approaches a vacuum, the cooling and velocity loss is diminished. It is desirable that the nozzle be positioned sufficiently distant from any surface so that the droplets are in a molten condition during cooling and solidification. If the nozzle is too close, the droplets may solidify after impact.

The stream of molten particles is directed into a cooling fluid. The cooling fluid typically disposed in a chamber which has an inlet to replenish the cooling fluid which is volitilized and heated by the molten particles. The Fluid may be provided in liquid form and volitized to the gaseous state during the rapid solidification process. The outlet is preferable in the form of a pressure relief value. The vented gas may be pumped to a collection tank and reliquified for reuse.

The choice of the particles cooling fluid depends on the desired results. If large cooling capacity is needed, it may be desirable to provide a cooling fluid having a high thermal capacity. An inert coolingfluid which is non-flammable and nonreactive may be desirable if contamination of the product is a problem. In other cases, a reactive atmosphere may be desirable to modify the powder. Liquid argon and liquid nitrogen are preferable nonreactive cooling fluids. Liquid hydrogen may be preferable in certain cases to reduce oxides and protect from unwanted reactions. If hydride formation is desirable, liquid hydrogen may enhance hydride formation. Liquid notrogen may enhance nitride formation.

Since the melting plasmas are formed from any of the same gases, the melting system and cooling fluid may be selected to be compatible.

The cooling rate depends on the thermal conductivity of the cooling fluid and themolten particles to be cooled, the size of the stream to be cooled, the size of individal droplets, and the temperature difference between the droplet and the cooling fluid. The cooling rate of the droplets is controlled by adjusting the above mentioned variables. The rate of cooling can be adjusted by adjusting the distance of the plasma from the liquid bath surface. The closer the nozzle to the surface of the bath, the more rapidly cooled the droplets.

Powder collection is conviently accomplished by removing the collected powder from the bottom of the collection chamber. The cooling fluid may be evaporated or retained if desired to provide protection against oxidation or unwanted reactions.

During the above described process, one portion of the stream of entrained and dispersed particles is substantially completely melted and another portion is only partially melted. Thus, when the entrained particles are subjected to conditions of rapid solidification, the substantially completely melted particles form rapidly solidified spherically shaped particles which have a uniform and homogeneous internal structure free from internal flaws. When the incompletely melted particles tend to have an outer portion which is resolidified surrounding an interior core portion that has not been melted. The interior core portion tends to retain some of surface boundaries of the original particles forming the agglomerate. The surface boundaries form flaws in the interior of the particle. Thus, the rapidly solidified spherically shaped particles require a first amount of energy for comminution and the resolidified particles, due to internal flaws require less energy to comminute.

In accordance with the principles of the present invention, the mixture of particles is subjected to a comminution energy which is less than that required to comminute the rapidly solidified particles but greater than that required to comminute the partially resolidified particles. Depending on the nature of the particles the comminution may be effected in various ways known in the art. Methods that impart high energy include milling with a ball mill or attritor milling. The time of milling and the milling medium may be adjusted to give the appropriate comminution energy. Less drastic comminution methods include jet milling where particles are driven against a surface. Other techniques include passing the powder through a pair of crushing rollers with gap between the rollers properly adjusted.

Next, the mixture which contains rapidly solidified large particles nad crushed partially solidified particles is separated by techniques known in the art such as air classification to concentrate the rapidly solidified large particles. Other techniques such as screening may also be used.

EXAMPLE 1

A Baystate, PG120-4, plasma gun is mounted in a chamber about 4 to about 6 inches from a block of dry ice. Agglomerated molybdenum powder (99.9 percent molybdenum) having a size distribution of about 56 percent −270 +325 and about 44 percent −325 mesh is fed to the gun at the rate of 8.85 pounds per hour entrained in argon at about 10 cubic feet per hour. The argon plasma gas is fed to the torch at the rate of about 60 cubic feet per hour. The torch power is about 30 volts at 600 amperes. The chamber has a nitrogen atmosphere. The powder is sprayed in a normal direction into a chamber containing liquid argon. The particles have smooth curvilinear surfaces tending toward sphericity. The particles which are most rapidly cooled appear to have amorphous properties. The powder mixture is ball milled for a period of about one hour, and air classified to obtain two fractions. One fraction consists essentially of rapidly solidified particles. The other fraction includes fragmented particles.

EXAMPLE 2

In a manner similar to Example 2, a powder consisting of nickel, chromium, and boron is plasma sprayed. The resulting powder which tends toward sphericity has an amorphous metastable structure.

EXAMPLE 3

In a manner similar to Example 1, the dry ice bed is replaced with a ceramic substrate comprising quartz which has a high thermal shock resistance. The substrate surface is smooth and the cooling gas of nitrogen is directed at the surface in the impact area in a direction tangential to the plasma stream.

I claim:

1. A process for preparing a rapidly solidified powder comprising entraining an agglomerated metal powder in a carrier gas, feeding the entrained agglomerated powder through a high temperature reactor to form a stream of dispersed particles, one portion of said dispersed particles being substantially completely melted and another portion being partially melted, directing said stream of dispersed particles into a cooling fluid at a temperature sufficient to subject said particles to conditions of rapid solidification and form an initial mixture of particles comprising rapidly solidified spherically shaped particles from said one portion and partially resolidified particles from said other portion, said rapidly solidified spherically shaped particles requiring a first amount of energy for comminution and said partially resolidified particles requiring a second amount of energy for comminution, said second amount of energy being less than said first amount of energy, subjecting said mixture to an energy for comminution intermediate said first and second energy for preferentially comminuting said other portion as compared with said one portion to give a resulting mixture containing comminuted particles, and separating a portion of said comminuted particles to give a final mixture including a greater proportion of rapidly solidifed spherically shaped particles than said initial mixture.

* * * * *